United States Patent [19]

Salomon

[11] 4,155,569

[45] May 22, 1979

[54] SAFETY SKI BINDING

[75] Inventor: Georges P. J. Salomon, Annecy, France

[73] Assignee: Establissements Francois Salomon et Fils, Annecy, France

[21] Appl. No.: 754,126

[22] Filed: Dec. 27, 1976

[30] Foreign Application Priority Data

Dec. 24, 1975 [FR] France ..... 75 39667

[51] Int. Cl.[2] ..... A63C 9/08; A63C 9/22

[52] U.S. Cl. ..... 280/625; 280/634

[58] Field of Search ..... 280/625, 634, 629, 630

[56] References Cited

U.S. PATENT DOCUMENTS

| | | | |
|---|---|---|---|
| 3,194,574 | 7/1965 | Beyl | 280/625 |
| 3,584,891 | 6/1971 | Khazzam | 280/625 |
| 3,638,959 | 2/1972 | Reuge | 280/625 |
| 3,881,737 | 5/1975 | Sentou | 280/625 |
| 3,993,327 | 11/1976 | Kaineder | 280/634 |

*Primary Examiner*—David M. Mitchell

*Attorney, Agent, or Firm*—Pollock, Vande Sande & Priddy

[57] ABSTRACT

A front stop for a ski binding is designed to accept boots of different widths, bearing in mind the possibilities of fitting offered by known heel-pieces mounted for resilient recoil. The front stop comprises two independent winged jaws hinged about a pivot on a mounting bracket secured to a ski. The stop is urged by a spring towards the position in which it closes onto the boot, and it comprises an adjustment device limiting closure of the jaws under the action of the spring the adjustment device being accommodated in one of the jaws. The front stop has the advantage of preventing the heel of the boot from resting upon the top of the heel-piece while the boot is being fitted to the binding.

6 Claims, 6 Drawing Figures

SAFETY SKI BINDING

The present invention relates to a device for binding one end of a boot, more particularly the front end or toe of the boot, to a ski, the other end of the boot being provided with a conventional type of binding known per se, more particularly a heel-piece.

Devices for binding the toe of a boot to a ski are already known, the devices comprising essentially two jaws designed to grip the front portion of the lateral edges of the sole of a boot, the jaws being urged towards the position in which they close onto the boot by a resilient means such as a spring.

In some of these devices, the jaws have independent wings hinged to a mounting bracket secured to the ski. A binding of this type was described by applicant in his U.S. Pat. No. 4,078,828, entitled "Improved device for binding the toe of a boot to a ski".

In bindings of this type, the toe of the boot is engaged by spreading the wings apart. Now, ski boots may vary greatly in width, especially in the case of adolescent junior and senior boots. In order, therefore, to engage the toe of a senior boot, the wings must be spread to a considerable extent against the action of the resilient means, which is not very practical. However, the major disadvantage of this binding is that, when the senior skier wishes to put the binding on, he cannot engage his boot between the wings of the front stop as far forward as the junior skier, since his boot is wider and his heel is displaced correspondingly towards the rear. This makes it difficult to engage the heel in the heel-piece (the heel being located above the jaw of the heel-piece, instead of above the refitting pedal); this major disadvantage will be described in greater detail in connection with one particular embodiment, and in conjunction with the figures attached hereto. This type of binding cannot therefore be used both for junior and senior boots. This makes it necessary to provide for a junior and a senior stop of different dimensions, especially as regards the jaw.

It is an object of the invention to eliminate this disadvantage.

It is also an object of the invention to facilitate the introduction of the toe of a boot between the wings of the front stop, and to facilitate engaging the boot in the heel-piece, regardless of the width of the boot.

It is another object of the invention to make it possible to adapt the type of binding described in the above-mentioned patent to enable it to accommodate boots of different widths and to allow engagement with the heel-piece without difficulty.

According to the basic characteristic of the present invention, these objects are achieved in that the binding comprises a control means for limiting the closing of the jaws subjected to the action of the resilient means. This control means is preferably accommodated in one of the jaws, more particularly it is interposed between the two jaws. The control means is also preferably adapted to move between two positions defining two possible degrees of separation of the jaws. However, the control means may also be arranged in quite a different manner. For instance it may also be accommodated in the sole clamp and may be inserted partly between the jaws.

This control means makes it possible for the skier to limit the closing of the wings voluntarily, depending upon the width of the boot. More particularly, he may set the opening of the wings to a value "a" for junior boots and to a value "b" for senior boots ("a" being less than "b"), so that the front end of the boot is at all times located in the vicinity of the stops with which it comes into contact and against which it bears.

A description will now be given of several embodiments of the binding according to the invention, in conjunction with the drawings attached hereto. wherein:

FIG. 1 is a plan view, in longitudinal section of a first embodiment of the binding according to the invention, in which the angle between the wings and the longitudinal axis of the binding has been set to a first value "a";

FIG. 1*a* is a side elevation of a front stop and a heel-piece showing the method of fitting a senior boot to a binding set for a junior boot;

Figure 3:
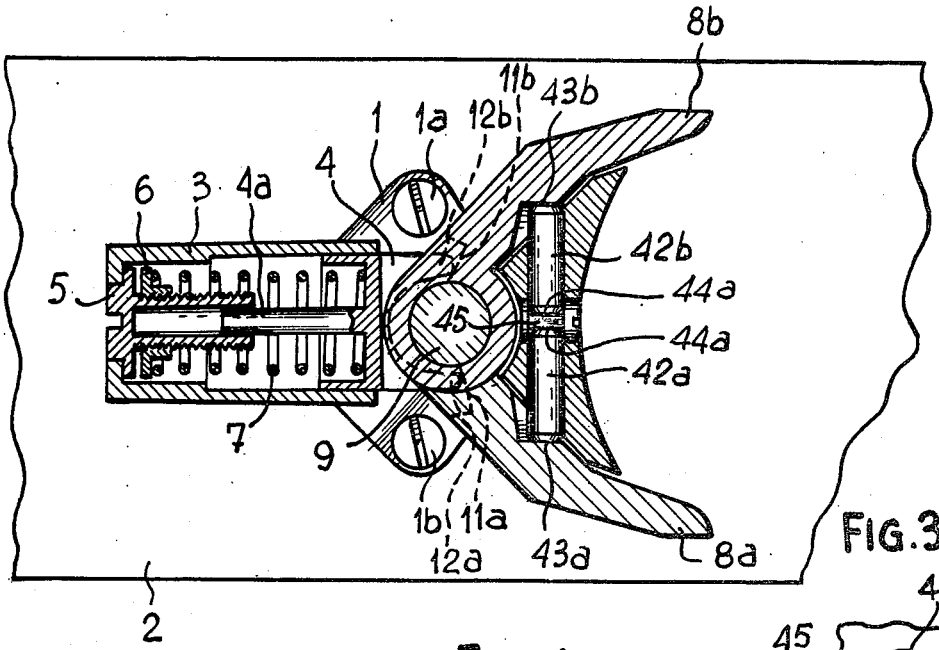
FIG. 3 is a plan view, in longitudinal section, of a second embodiment, in which the control means is accommodated in the sole clamp and is located between the two wings.
Figure 3A:
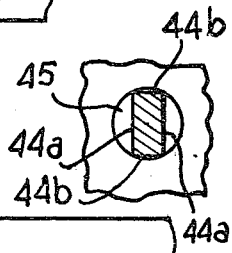
Figure 4:
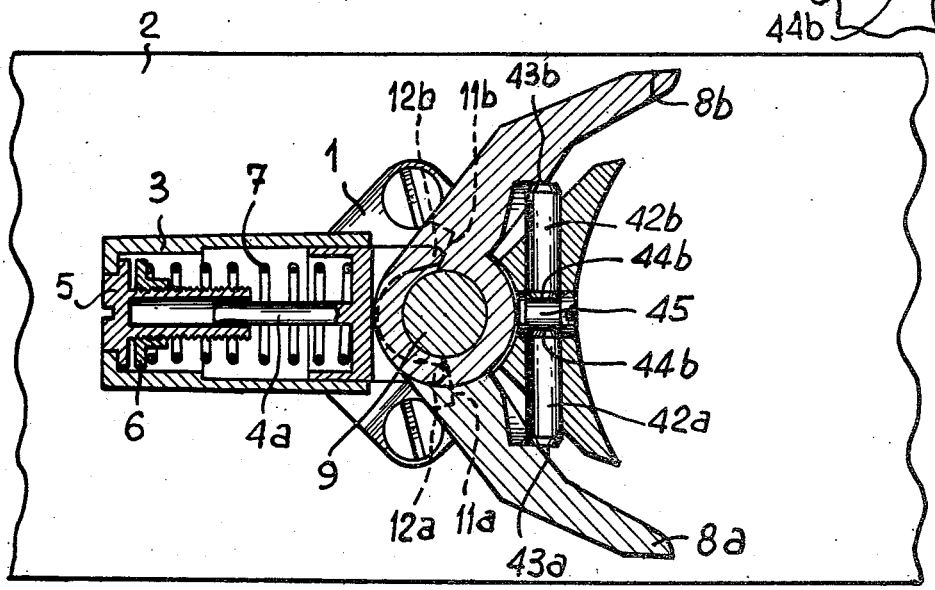

FIG. 3*a* is a cross-sectional view of one of the parts of the means for controlling the spread of the wings of a front stop, described in connection with FIG. 3; and FIG. 4 is a plan view, in longitudinal section, of the embodiment illustrated in FIG. 3, with the spread between the wings adjusted to a setting different from that shown in FIG. 3.

Figure 1:
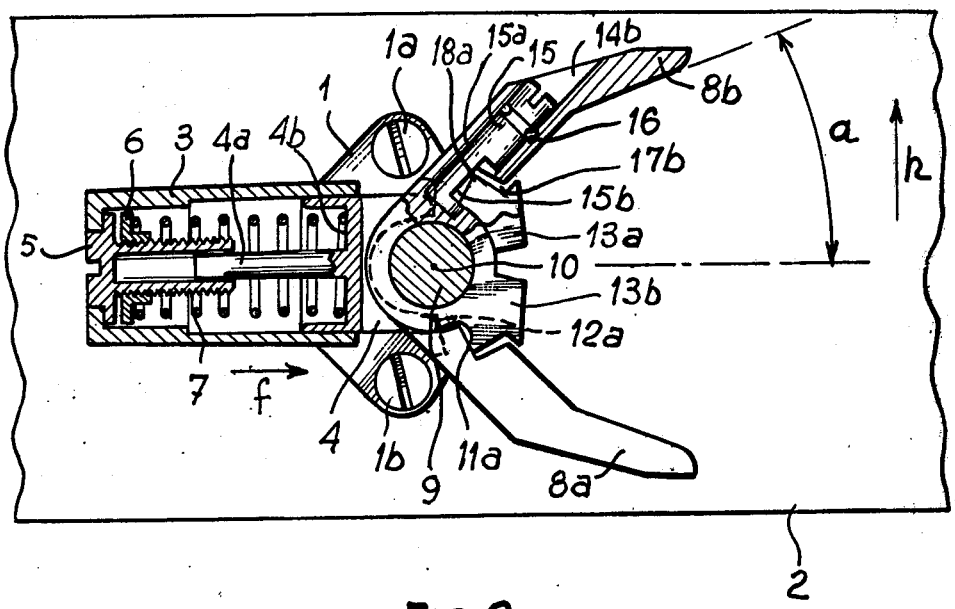

FIG. 1 is a plan view, in longitudinal section, of a front stop. This stop (except for the control means according to the present invention) has been described in detail by applicant in the above-mentioned patent. A brief reference will be made here to the essential elements of this binding, and to their functions, to the extent required for an understanding of the present invention.

The front stop comprises a baseplate 1 secured to a ski 2 by screws such as 1*a* and 1*b*. This baseplate extends forwardly in the form of a cylindrical hollow body 3 in which a piston 4 slides; the longitudinal axis of the hollow cylindrical body is parallel to that of the ski. The axial movement of piston 4 is guided by a pin 4*a* located on the longitudinal axis of the hollow body and sliding within a part 5 which closes off the front end of the hollow body. This part 5 is mounted upon hollow body 3 in such a manner as to be able to pivot about the longitudinal axis thereof. It is drilled externally to accomodate a threaded dowel 6. A coil spring 7, located within the hollow body, has one end bearing against the threaded dowel 6 while the other end bears against surface 4*b* of piston 4; spring 7 urges piston 4 in the direction of arrow "f". It is pointed out at this time that rotating closing part 5 enables the skier to adjust the tension of spring 7, dowel 6 being prevented from rotating.

The binding also comprises two independent winged jaws 8*a*, 8*b* adapted to rotate about a vertical pivot 9, axis 10 of which is perpendicular to the plane of the ski and is located in the longitudinal plane of symmetry thereof. Wings 8*a*, 8*b* comprise supporting surfaces 11*a*, 11*b* respectively (surface 11*a* is visible in FIG. 1), the surfaces being designed to co-operate with two projecting parts 12*a*, 12*b* which prolong the other surface of piston 4 (projecting part 12*a* of piston 4 is visible); wings 8*a*, 8*b*, which rotate independently about pivot 9, are also integral with supports 13*a*, 13*b* respectively, the supports comprising surfaces against which the front of the boot is stopped.

A brief description will now be given of the operation of this binding.

Figure 1A:
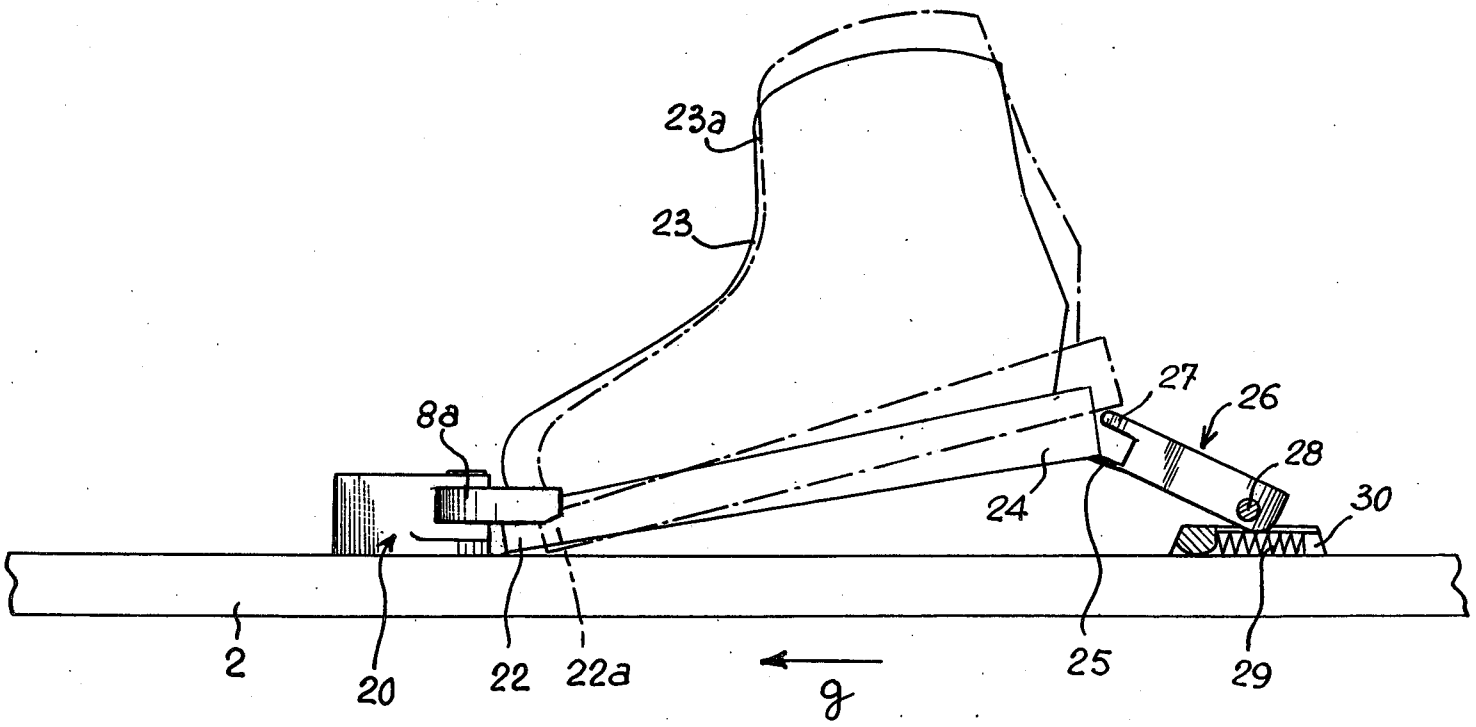

The principle upon which the binding operates, when the boot is being fitted, is shown in FIG. 1*a*. Illustrated in this figure is a side elevation of front stop 20 secured to a ski 2; front end 22 of boot 23 bears against wings 8*a*, 8*b* of the front stop (only wing 8*a* is visible in the figure). Rear end 24 of boot 13 bears upon a pedal 25 which is hinged in relation to heel-piece 26, the latter comprising a jaw 27 adapted to rotate about a transverse pivot 28 mounted upon ski 2. This jaw moves between a low position in which the jaw is locked in relation to the ski and secures the rear end of the boot, and a raised position which allows the rear end of the boot to escape freely from the heel-piece (this is the position shown in FIG. 1*a*).

In order to put his skis on, the skier introduces front end 22 of his boot between wings 8*a*, 8*b* and depresses pedal 25 with the heel of the boot, pivoting his boot about its front end 22. During this movement, the boot is pushed slightly forward by the heel-piece, in the direction of arrow "g"; the effect of this forward movement of the ski is to spread wings 8*a*, 8*b* slightly against the action of spring 7. The boot moves forward, under the knuckle action of the heel-piece, until front end 22 of the boot bears against supports 13*a*, 13*b* integral with wings 8*a*, 8*b*. Heel-piece 26 may with advantage be mounted upon a longitudinal sliding system actuated by a return spring 29 located in baseplate 30 of the heel-piece. It is also possible to make use, in a manner known per se, of resilient means in the locking system for jaw 27.

However, the possibilities of adapting this binding to boots of various widths and lengths are limited. In order to illustrate this difficulty, let us imagine that the front stop is set for a junior boot and let us then see what happens when a senior wishes to use the binding. As indicated above, the senior introduces end 22*a* of his boot 23*a* (illustrated in dotted line in FIGS. 1 and 1*a*). Now since his boot is wider than the junior boot, he cannot push it as far forward between wings 8*a*, 8*b*. The result of this is that the heel of his boot, instead of bearing upon the pedal, bears upon the upper part of the jaw, as shown in dotted lines in FIG. 1*a*. This shows that it is difficult for a senior to use a binding adapted for a junior. If the senior attempts to overcome this difficulty by pushing the toe of his boot forward in order to spread wings 8*a*, 8*b* farther apart, not only will this fail to solve the problem, but he will be faced with still another difficulty, since it must be remembered that the ski is free to slide on the snowy ground upon which it rests; if, therefore, the skier pushes against the front stop with the toe of his boot, he will merely cause the ski to slide on the snow, instead of spreading wings 8*a*, 8*b* farther apart, and although this would seem to be the natural thing to do, it only increases the difficulty of fitting a senior boot.

Heel-pieces are known to be designed to move longitudinally backwards along the ski, against the action of springs, when the ski is being put on under normal conditions. If, under the present circumstances, the skier were to push the heel-piece back to allow the boot to assume its normal position in relation to the fitting pedal, the heel-piece would not move back when the boot is fitted; instead, the boot would move forward and would spread the wings of the stop apart. In this case the boot would not be held longitudinally, which might well lead to an inopportune release.

A description will now be given, in conjunction with FIG. 1, of the control means according to the invention which allows the senior to set the stop for his own use very conveniently and very quickly.

To this end, wing 8*b* has an internal cylindrical housing 14*b*, in which an adjusting part 15 having two, radially different surfaces 15*a*, 15*b*, is mounted rotatably about the longitudinal axis of the housing. Part 15 is secured axially in relation to wing 8*b* by means of a split-pin 16.

It will now be shown that the control means according to the invention makes it possible for a senior to use a binding set for a junior.

When a senior wishes to use a binding which has been set for a junior, all he has to do is increase the spread (angle of separation) of wings 8*a*, 8*b* by rotating part 15, as already described. Although his boot is wider, he will now be able to place it between the wings as far forward as the junior boot, and his heel will no longer come to rest upon the top of jaw 27, as it does with a binding not fitted with the control means according to the invention.

A description will now be given, in conjunction with FIGS. 3 and 4, of a new variant of the control means according to the invention, which makes it possible to vary the spread between the wings of a front stop.

Figure 2:
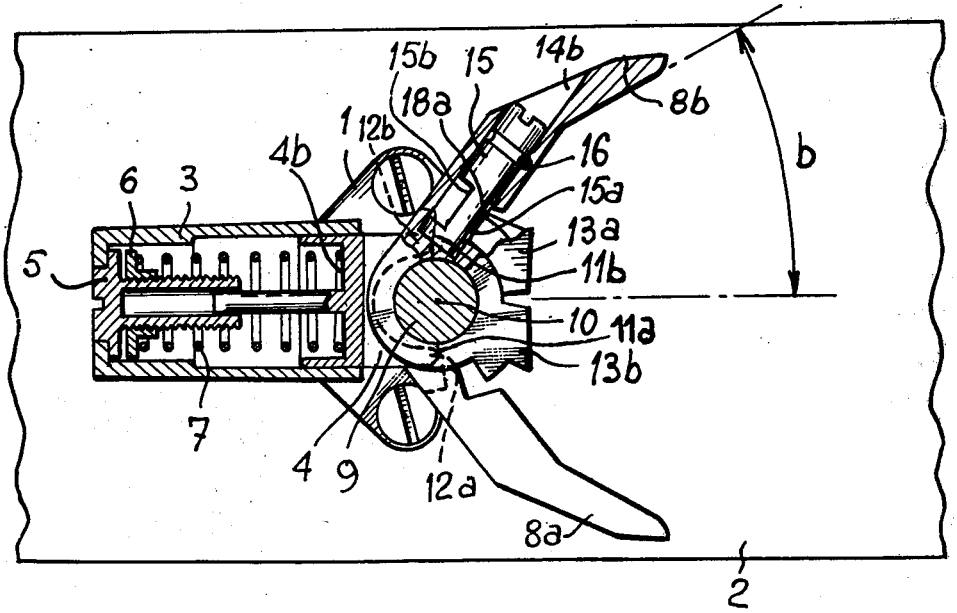
FIG. 2 is a plan view, in longitudinal section, of the embodiment illustrated in FIG. 1, with the angle between the wings and the longitudinal axis set to a second value "b"

Elements identical with those described in connection with FIGS. 1, 1*a* and 2 may be seen in FIGS. 3 and 4, and these elements bear the same reference numerals. In this case, the front stop also comprises a sole clamp 40 integral with pivot 9 and designed to secure the boot and to prevent it from escaping vertically from the front stop.

The sole clamp has a transverse passage at right angles to the axis of the ski and substantially parallel with the plane of the ski, the passage 41 being substantially cylindrical. Two tappets 42*a*, 42*b* slide in this passage 41, the ends of the tappets bearing respectively against (a) support faces 43*a*, 43*b*, integral with wings 8*a*, 8*b*, and (b) faces 44*a*, 44*b* of an intermediate part 45 located between the tappets 42*a*, 42*b*.

This intermediate part is mounted rotatably within a housing in the sole clamp, about an axis parallel with the longitudinal axis of the binding. The profiles of surfaces 44*a*, 44*b* of part 45 are such that the distance between tappets 42*a*, 42*b* may be varied by rotating part 45. FIG. 3*a* shows a cross-sectional view (at right angles to the axis of rotation) of intermediate part 45, in order to demonstrate the profiles of surfaces 44*a*, 44*b*.

What is claimed is:

1. A safety binding for a ski boot, said binding comprising: two winged jaws hinged to a mounting bracket on a ski and subjected to the action of a resilient restoring means urging said jaws towards each other and towards the position in which they close onto the boot; said binding further comprising control means adjustably limiting the closure of said jaws subjected to the action of said restoring means, said control means being accommodated solely in one of said jaws and bearing against the other.

2. A binding according to claim 1, wherein said control means comprises of a control part rotatable within a housing arranged in one of the jaws, said control part comprising two surfaces against which a projecting part, integral with the other jaw, may bear as the control part is rotated in its housing, and said surfaces being spaced differently from the axis of rotation of said control part.

3. A binding according to claim 1, wherein said control means is movable between two positions defining two possible degrees of separation of said jaws.

4. A binding according to claim 1, wherein said jaws are hinged about a single vertical pivot.

5. A binding according to claim 1, wherein said winged jaws are independent.

6. A binding according to claim 1, wherein each jaw comprises a stop against which the end of the boot bears when fitted to the binding.

* * * * *